US009336914B2

(12) United States Patent
Itou et al.

(10) Patent No.: US 9,336,914 B2
(45) Date of Patent: May 10, 2016

(54) RADIOACTIVE WASTE SOLIDIFICATION METHOD

(71) Applicant: Hitachi-GE Nuclear Energy, Ltd., Hitachi-shi, Ibaraki (JP)

(72) Inventors: Tsuyoshi Itou, Tokyo (JP); Kenji Noshita, Hitachi (JP); Takashi Asano, Hitachi (JP)

(73) Assignee: Hitachi-GE Nuclear Energy, Ltd., Hitachi-shi (JP)

( * ) Notice: Subject to any disclaimer, the term of this patent is extended or adjusted under 35 U.S.C. 154(b) by 0 days.

(21) Appl. No.: 14/799,997

(22) Filed: Jul. 15, 2015

(65) Prior Publication Data

US 2016/0027544 A1 Jan. 28, 2016

(30) Foreign Application Priority Data

Jul. 23, 2014 (JP) ..... 2014-149967

(51) Int. Cl.
*G21F 9/16* (2006.01)
*G21F 9/30* (2006.01)

(52) U.S. Cl.
CPC ..... *G21F 9/305* (2013.01)

(58) Field of Classification Search
CPC ..... G21F 9/16; G21F 9/00; B09B 3/00; B09B 5/00; C02F 11/00; C03B 5/00; C03B 5/027; E02D 3/11; H05B 3/00; B65D 90/24; B65D 90/50
USPC ..... 588/11, 252, 253, 259, 901
See application file for complete search history.

(56) References Cited

FOREIGN PATENT DOCUMENTS

| | | | |
|---|---|---|---|
| JP | 62-124499 | A | 6/1987 |
| JP | 62-165198 | A | 7/1987 |
| JP | 2007-132787 | A | 5/2007 |
| JP | 2011-46996 | A | 3/2011 |

*Primary Examiner* — Edward Johnson
(74) *Attorney, Agent, or Firm* — Crowell & Moring LLP

(57) ABSTRACT

A radioactive waste (zeolite to which Cs-137 was adsorbed) in a waste tank and a glass raw material (soda lime glass) in a glass raw material tank are supplied into a solidifying vessel. Graphite in a graphite tank is also supplied into the solidifying vessel. The solidifying vessel is filled with a mixture of the radioactive waste, glass raw material, and graphite and is then disposed in an adiabatic vessel. The radioactive waste and glass raw material in the adiabatic vessel are heated by thermal energy generated due to radiation emitted from Cs-137. The heat is transferred to the peripheral portion of the solidifying vessel through the graphite, raising the temperature of the peripheral portion. The glass raw material is melted and enters clearances among the radioactive waste, producing a vitrified radioactive waste. This radioactive waste solidification method can shorten a time taken to produce a vitrified radioactive waste.

8 Claims, 4 Drawing Sheets

RADIOACTIVE WASTE SOLIDIFICATION METHOD

CLAIM OF PRIORITY

The present application claims priority from Japanese Patent application serial no. 2014-149967, filed on Jul. 23, 2014, the content of which is hereby incorporated by reference into this application.

BACKGROUND OF THE INVENTION

1. Technical Field

The present invention relates to a radioactive waste solidification method, and more particularly to a radioactive waste solidification method suitable to processing of high-dose radioactive waste having a high radioactive level.

2. Background Art

Radioactive waste generated from a nuclear facility and the like are solidified with cement or glass and are then converted to a form suitable for storage, transportation, and burial processing. Solidification with cement of various types of solidification processing is a method in which radioactive waste is solidified with cement and water, so this method is inexpensive and is also advantageous in that processing is easily performed. When high level radioactive waste is solidified with cement in a solidifying vessel, however, moisture included in a cemented radioactive waste generated by the cement solidification is subjected to radiolysis, generating a hydrogen gas. This hydrogen gas may affect the cemented radioactive waste itself or a facility after burial processing (refer to Japanese Patent Laid-open No. 2007-132787).

Therefore, in a radioactive waste solidification method described in Japanese Patent Laid-open No. 2007-132787, radioactive waste, cement, and water are mixed in a drum which is a solidifying vessel to produce a cemented radioactive waste, and the cemented radioactive waste is dried to eliminate moisture from the cemented radioactive waste through heating or pressure reduction at a stage in which uniaxial compression strength is 1.5 MPa or more and is 75% or less of predicted strength.

In solidification with glass in which water is not used, so even if a radioactive waste is at a high radioactive level, there is no fear that a hydrogen gas is generated. As described in Japanese Patent Laid-open No. 2011-46996, however, solidification with glass involves processing at a high temperature, so that a large melting facility and the like are needed.

Japanese Patent Laid-Open No. 62(1987)-124499 describes a radioactive waste solidification method. In this radioactive waste solidification method, solid or liquid radioactive waste are mixed with glass with a low melting point (the melting point is 400° C. to 800° C.), and the resulting mixture of the waste and glass is subjected to molding and baking or is melted by being heated and a vitrified radioactive waste is produced.

Japanese Patent Laid-Open No. 62(1987)-165198 describes a hydrothermal solidification method for high-level radioactive waste. In this hydrothermal solidification method for high-level radioactive waste, high-level radioactive waste, glass, and quartz powder are mixed, and the resulting mixture is further mixed with water. This mixture is supplied into a canister. The mixture in the canister is heated to 300° C. due to decay heat of the high-level radioactive waste, producing a vitrified radioactive waste through a hydrothermal reaction. In this hydrothermal solidification method for high-level radioactive waste, the surfaces of glass and quartz powder are melted due to decay heat and high-level radioactive waste is bonded.

CITATION LIST

Patent Literature

[Patent Literature 1] Japanese Patent Laid-Open No. 2007-132787

[Patent Literature 2] Japanese Patent Laid-Open No. 2011-46996

[Patent Literature 3] Japanese Patent Laid-Open No. 62(1987)-124499

[Patent Literature 4] Japanese Patent Laid-Open No. 62(1987)-165198

SUMMARY OF THE INVENTION

Technical Problem

As for solidification of high-dose radioactive waste, solidification with glass in which a hydrogen gas due to radiation is not generated is preferable. Although conventional methods of solidification with glass are problematic in that a large melting facility is needed, the hydrothermal solidification method for high-level radioactive waste described in Japanese Patent Laid-Open No. 62(1987)-124499 can solve the above problem because decay heat of high-level radioactive waste is used to melt glass and crystal powder. In the method described in Japanese Patent Laid-Open No. 62(1987)-124499, however, high-level radioactive waste is solidified in a hydrothermal solidification method in which added water is used. Although decay heat of high-level radioactive waste is used, part of the decay heat is used to evaporate water because a hydrothermal solidification method is used. Accordingly, the high-level radioactive waste is solidified by melting only the surfaces of glass and crystal powder. The produced vitrified radioactive waste is a non-uniform substance including water and steam and radioactive nuclides are thereby likely to leak from the vitrified radioactive waste.

An object of the present invention is to provide a radioactive waste solidification method that can further shorten a time taken to produce a vitrified radioactive waste.

Solution to Problem

A feature of the present invention for attaining the above object is a radioactive waste solidification method comprising steps of:

supplying radioactive waste including radioactive nuclides, glass raw materials, and graphite into a first vessel;

disposing the first vessel in which the radioactive waste, glass raw materials, and graphite exist, in an adiabatic area in a second vessel;

heating the radioactive waste and glass raw materials existing in the first vessel disposed in an adiabatic area in the second vessel by heat generated by radiation emitted from the radioactive nuclides and melting the glass raw material in the first vessel; and producing a vitrified radioactive waste by the melt of the heated glass raw materials.

The first vessel, in which the radioactive waste including radioactive nuclides, glass raw materials, and graphite exist, is disposed in the adiabatic area in the second vessel, and the glass raw materials in the first vessel are then melted in the adiabatic area by heat generated from radiation emitted from the radioactive nuclides. At that time, heat at the central portion on the traverse plane of the first vessel is transferred to the circumferential portion on the traverse plane through the graphite. Accordingly, the grass materials existing in the circumferential portion are melted fast. This can further shorten a time taken to produce a vitrified radioactive waste.

Another way to achieve the above object is to supply radioactive waste including radioactive nuclides and glass raw materials into each of a plurality of waste filling areas, which are formed in a first vessel with heat transfer members, to dispose the first vessel, in which radioactive waste and glass raw materials exist, in an adiabatic area in a second vessel, to heat the radioactive waste and glass raw materials in the first vessel, which exists in the adiabatic area in the second vessel, in the adiabatic area by heat generated by radiation emitted from the radioactive nuclides, and to produce a vitrified radioactive waste of radioactive waste by melt of the heated glass raw materials.

The first vessel, in which the radioactive waste including radioactive nuclides and glass raw materials exist in the waste filling areas formed with the heat transfer members, is disposed in the adiabatic area in the second vessel, and then the glass raw materials in the first vessel are melted in the adiabatic area by heat generated by radiation emitted from the radioactive nuclides. At this time, heat at the central portion on the traverse plane of the first vessel is transferred to the circumferential portion on the traverse plane by the heat transfer members. Accordingly, the grass materials present in the circumferential portion are melted fast, so that a time taken to create a vitrified radioactive waste can be further shorten.

Advantageous Effect of the Invention

According to the present invention, a time taken to produce a vitrified radioactive waste can be further shortened.

DETAILED DESCRIPTION OF THE PREFERRED EMBODIMENTS

Figure 1:
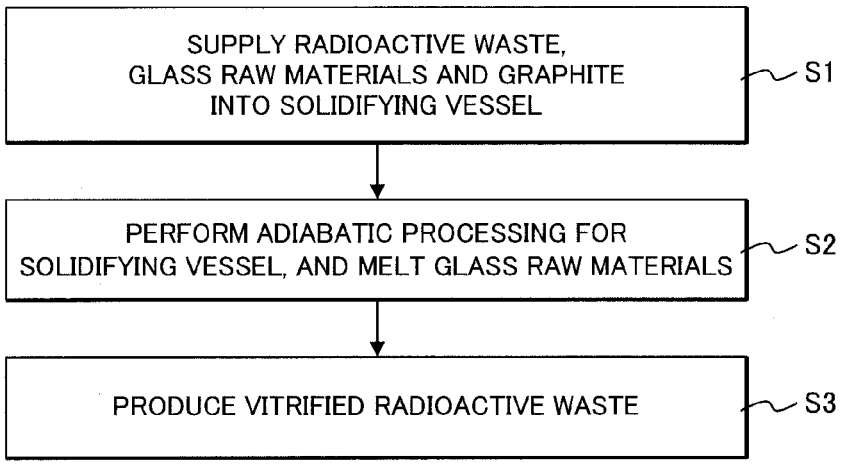
FIG. 1 is a flowchart showing a processing procedure in a radioactive waste solidification method according to an embodiment 1, which is a preferred embodiment of the present invention.

When a solidifying vessel filled with a mixture of high-dose radioactive waste and glass raw materials, which are solidifying materials, is disposed in an adiabatic state by, for example, surrounding the solidifying vessel with an adiabatic member or evacuating the interior of the solidifying vessel and the glass raw materials in the solidifying vessel are melted by using decay heat of radioactive nuclides included in the radioactive waste, the glass raw materials in the solidifying vessel are uniformly heated and a uniform vitrified radioactive waste of radioactive waste can thereby be produce due to the melted glass raw materials. That is, much radiation energy is emitted from high-dose radioactive waste, so when the radioactive waste themselves and glass raw materials, which are solidifying materials, absorb the radiation, thermal energy into which the radiation energy has been converted is stored in the radioactive waste and glass raw materials. Accordingly, the temperature in the glass raw materials in the solidifying vessel can be uniformly raised to a temperature needed to melt the glass raw materials, regardless of the positions of the glass raw materials in the solidifying vessel.

When a solidifying vessel filled with a mixture of radioactive waste and glass raw materials is surrounded with an adiabatic member as described above, emission of decay heat of the radioactive waste from the solidifying vessel to the outside is suppressed. This can reduce a difference in temperature between the central portion and circumferential portion on the traverse plane of the solidifying vessel filled with a mixture of radioactive waste and glass raw materials and can increase the average temperature on the traverse plane.

However, it is desirable to further shorten a time taken to produce a vitrified radioactive waste including radioactive materials. Although it is possible to reduce a difference in temperature between the central portion and circumferential portion on the traverse plane of the solidifying vessel by surrounding a solidifying vessel filled with radioactive waste and glass raw materials with an adiabatic member, the temperature at the central portion on the traverse plane of the solidifying vessel is still higher than the temperature in its circumferential portion on the traverse plane due to the store of the above decay heat at the central portion on the traverse plane of the solidifying vessel. Accordingly, the inventors considered that if heat at the central portion on the traverse plane of the solidifying vessel is transferred fast to the circumferential portion on the traverse plane, the glass raw materials existing in the circumferential portion can be melted fast accordingly and, as a result, a time taken to produce a vitrified radioactive waste including radioactive materials can be further shortened. Thus, the inventors carried out experiments for case 1 in which a solidifying vessel filled with graphite with superior thermal conductivity, such as linear graphite, together with radioactive waste and glass raw materials is disposed in an adiabatic vessel formed with an adiabatic material and case 2 in which a solidifying vessel filled with radioactive waste and glass raw materials but not filled with graphite is disposed in the above adiabatic vessel. As a result, the inventors confirmed that a temperature rise at the circumferential portion on the traverse plane of the solidifying vessel is faster in case 1 than in case 2 and that the difference in temperature between the central portion and circumferential portion on the traverse plane of the solidifying vessel can be further reduced in case 1 when compared with case 2. This indicates that in case 1, heat at the central portion on the traverse plane of the solidifying vessel was transferred fast to the circumferential portion on the traverse plane due to graphite. Much more time taken to produce the vitrified radioactive waste including radioactive materials could be shortened in case 1 than in case 2.

Embodiments of the present invention in which the above study results are considered will be described below.

Embodiment 1

Figure 2:
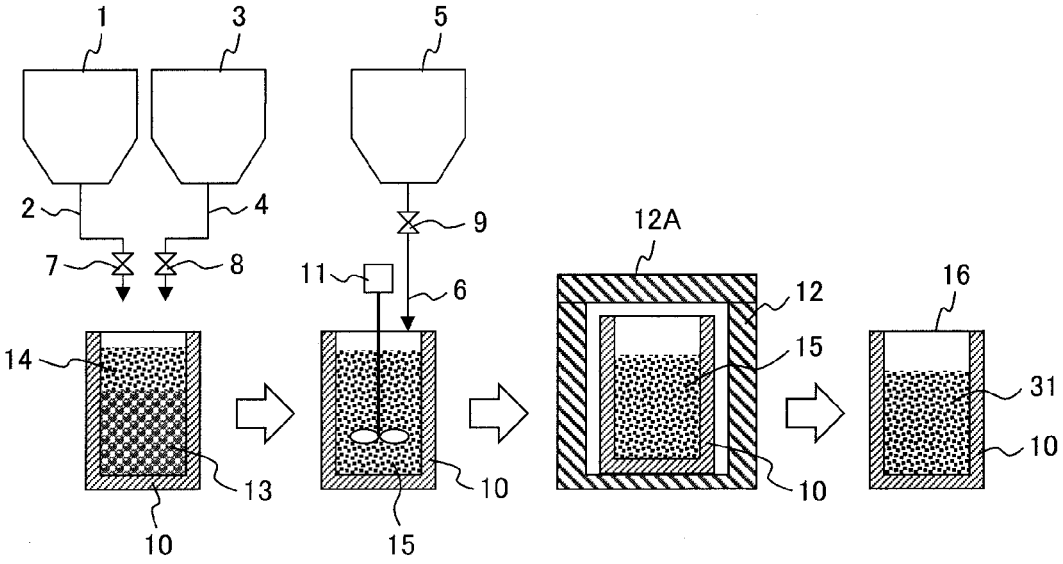
FIG. 2 is an explanatory drawing showing a concrete example of a radioactive waste solidification method according to embodiment 1 shown in FIG. 1.

A radioactive waste solidification method according to embodiment 1, which is a preferred embodiment of the present invention, will be described with reference to FIGS. 1 and 2. In the radioactive waste solidification method in the present embodiment, 100 kg of high-dose radioactive waste that includes $10^{16}$ Bq of Cs-137 (for example, zeolite to which Cs-137 has been adsorbed) as high-dose radioactive waste, 100 kg of soda lime glass, which is a glass raw material, with a glass softening point of approximately 700° C., and 20 kg of linear graphite, which is a material with superior thermal conductivity, were supplied into a solidifying vessel and a vitrified radioactive waste is produced. The radioactive waste solidification method in the present embodiment will be described below with reference to the procedure shown in FIG. 1.

Radioactive waste, glass raw materials, and graphite are supplied into a solidifying vessel (step S1). Specifically, a metallic (or ceramic) vacant solidifying vessel (first vessel) 10 is disposed below a waste tank 1 in which radioactive waste have been stored and a glass raw material tank 3. First, 100 kg of high-dose radioactive waste 13, which includes $10^{16}$ Bq of Cs-137, in a waste tank 1 is supplied into the solidifying vessel 10 through a waste supply pipe 2 connected to the waste tank 1 by opening an opening and closing valve 7 attached to the waste supply pipe 2. In the present embodiment, the radioactive waste supplied into the solidifying vessel 10 is, for example, zeolite to which the above Cs-137 has been adsorbed. Furthermore, 100 kg of soda lime glass, which is a glass raw material 14 in the glass raw material tank 3, is supplied into the solidifying vessel 10 through a glass raw material supply pipe 4 connected to the glass raw material tank 3 by opening an opening and closing valve 8 attached to the glass raw material supply pipe 4.

After that, the solidifying vessel 10 filled with the radioactive waste 13 and glass raw material 14 is moved to a position immediately below a graphite tank 5 filled with graphite. The linear graphite in the graphite tank 5 is supplied into the solidifying vessel 10 while the radioactive waste 13 and glass raw material 14 (soda lime glass) in the solidifying vessel 10 are being mixed by being agitated with an agitator 11. Supply of the graphite into the solidifying vessel 10 is performed through a graphite supply pipe 6 by opening an opening and closing valve 9 attached to the graphite supply pipe 6 connected to the graphite tank 5. Then, 20 kg of graphite is supplied into the solidifying vessel 10. The radioactive waste 13, glass raw material 14, and graphite in the solidifying vessel 10 are mixed with the agitator 11. As a result, 220 kg of a mixture 15 of the radioactive waste 13, glass raw material 14, and graphite is present in the solidifying vessel 10. Therefore, the size of the solidifying vessel 10 is large enough to include 220 kg of the mixture 15.

Adiabatic processing is performed for the solidifying vessel filled with the radioactive waste and the glass raw materials are melted (step S2). Specifically, the solidifying vessel 10 filled with the radioactive waste 13, glass raw material 14, and graphite, which have been mixed as the mixture 15, is disposed in an adiabatic vessel (second vessel) 12 with its upper end open. The adiabatic vessel 12 has a lid 12A, which is removable, at the upper end. In disposing the solidifying vessel 10 in the adiabatic vessel 12, the lid 12A is removed, making the solidifying vessel 10 upwardly open. In this state, the solidifying vessel 10 is disposed in the adiabatic vessel 12 from above. After that, the lid 12A is attached to the upper end of the adiabatic vessel 12 to seal the adiabatic vessel 12 in which the solidifying vessel 10 is disposed. The adiabatic vessel 12 and lid 12A are made of an adiabatic material. For example, they are made of glass wool. In the sealed adiabatic vessel 12, an adiabatic area, which is thermally insulated by the adiabatic vessel 12, is formed. The solidifying vessel 10 filled with the radioactive waste 13, glass raw material 14, and graphite is disposed in this adiabatic area.

The adiabatic vessel 12 has a double structure in which an inner vessel (not shown) is disposed in a metallic outer vessel (not illustrated). Glass wool is disposed in an annular area between the outer vessel and the inner vessel and in a space between the bottom of the outer vessel and the bottom of the inner vessel. The upper end of the annular area between the outer vessel and the inner vessel is sealed with a ring-shaped plate attached to the upper end of the outer vessel and another ring-shaped plate attached to the upper end of the inner vessel. The lid 12A is formed by filling a metal hollow case (not illustrated) with glass wool.

After that, adiabatic processing is performed on the solidifying vessel 10 disposed in the sealed adiabatic vessel 12. The adiabatic processing means processing to suppress heat of the solidifying vessel 10 which is emitted the outside. In the solidifying vessel 10 that has been subjected to the adiabatic processing, heat (decay heat) is generated based on radiation emitted from Cs-137, which is a radioactive nuclide, included in the radioactive waste 13 in the solidifying vessel 10. Emission of this decay heat to the outside is suppressed by the adiabatic vessel 12 sealed with the lid 12A, and the decay heat is stored in the interior of the adiabatic vessel 12 sealed with the lid 12A, that is, in the adiabatic vessel 12 sealed with the lid 12A. This decay heat is efficiently transferred to the glass raw material 14 through the graphite, so that the glass raw material 14 in the solidifying vessel 10 is heated and melted.

Since the solidifying vessel 10 filled with the radioactive waste 13, glass raw material 14, and graphite is surrounded by the adiabatic vessel 12 and lid 12A, the respective temperatures of the radioactive waste 13, glass raw material 14, and graphite stored in the solidifying vessel 10 disposed in the adiabatic vessel 12, the solidifying vessel 10 being heated by decay heat of the radioactive waste 13, do not become non-uniform depending on their positions in the solidifying vessel 10 but become substantially uniform. Particularly, since the solidifying vessel 10 is disposed in the adiabatic vessel 12, the temperature on the traverse plane of the solidifying vessel 10, which includes the radioactive waste 13, glass raw material 14, and graphite heated by the decay heat, is raised, and a difference in temperature between the central portion and circumferential portion on the traverse plane of the solidifying vessel 10 is reduced when compared with a case in which the solidifying vessel 10 is not surrounded by the adiabatic vessel 12. However, since heat is stored in the central portion on the traverse plane, the temperature at the central portion on the traverse plane is higher than the temperature in the circumferential portion on the traverse plane. In the present embodiment, graphite is supplied into the solidifying vessel 10, so that heat at the central portion on the traverse plane of the solidifying vessel 10 is transferred to the glass raw material 14 existing in the circumferential portion on the traverse plane through some graphite pieces existing in the solidifying vessel 10. Therefore, the temperature in the circumferential portion on the traverse plane of the solidifying vessel 10 is raised faster than when graphite pieces are not present, and the difference in temperature between the central portion and circumferential portion on the traverse plane of the solidifying vessel 10 is further reduced. As a result, the soda lime glass, which is the glass raw material 14, existing in the circumferential portion on the traverse plane of the solidifying vessel 10 is melted fast.

For example, Cs-137, which is a radioactive nuclide included in the radioactive waste 13, emits radiation with approximately 1.15 MeV of energy per disintegration. This radiation is absorbed in the radioactive waste 13, glass raw material (soda lime glass) 14, and graphite, and is then converted to thermal energy (decay heat). Since the radioactive waste 13 filled in the solidifying vessel 10 includes $10^{16}$ Bq of Cs-137, if radiation emitted from each Cs-137 is all absorbed in the radioactive waste 13, glass raw material 14, and graphite in the solidifying vessel 10, thermal energy of 1.15 MeV× $10^{16}$ Bq=1.15 E22 eV/s, that is, at a heat generation rate of 1840 J/s, is obtained. If the specific heat of the mixture 15 of the radioactive waste (zeolite to which Cs-137 has been adsorbed) 13, glass raw material (soda lime glass) 14, and graphite is 0.5 J/(g·K), the respective temperatures of the radioactive waste 13, glass raw material 14, and graphite are raised by approximately 66° C. per hour. The soda lime glass, which is the glass raw material 14, is melted due to this temperature rise and flows into clearances formed among the radioactive waste 13, graphite, and the like. If a liquid is included in the radioactive waste 13, this liquid is heated by the heat described above and is turned into a vapor.

A vitrified radioactive waste is produced (step S3). Since some heat is emitted to the outside through the adiabatic vessel 12 and lid 12A, an actual temperature rise rate in the solidifying vessel 10, particularly in the circumferential portion on the traverse plane of the solidifying vessel 10, is lower than 66° C./h. However, a temperature rise is continued with time, so all glass raw materials 14 are melted. As a result, clearances formed among the radioactive waste 13, graphite, and the like are filled with the melted substance of the glass raw material 14. As a time elapses, the melted glass raw material 14 coagulates in the solidifying vessel 10, and a glass-solidified substance 31 is produced in the solidifying vessel 10. The glass-solidified substance 31 includes the radioactive waste 13 and graphite, which were combined together by the coagulated glass raw material (soda lime glass) 14. Then, the lid 12A is removed from the adiabatic vessel 12, and the solidifying vessel 10, in which the glass-solidified substance 31 has been formed, is taken out from the adiabatic vessel 12. A lid (not shown) is attached to the upper end of the solidifying vessel 10, which internally includes the glass-solidified substance 31, to seal the solidifying vessel 10, producing a vitrified radioactive waste 16. The vitrified radioactive waste 16 is stored in a prescribed storage place (not shown).

Since, in the present embodiment, the solidifying vessel 10 filled with the radioactive waste 13, glass raw material 14, and graphite is surrounded in the adiabatic vessel 12 sealed with the lid 12A, radiation emitted as a result of the decay of radioactive nuclides included in the radioactive waste 13 is absorbed in the radioactive waste 13, glass raw material 14, and graphite in the solidifying vessel 10 disposed in the adiabatic area in the adiabatic vessel 12 and the resulting thermal energy (decay heat) heats the radioactive waste 13, glass raw material 14 and graphite. In addition, heat at the central portion on the traverse plane of the solidifying vessel 10 is more efficiently transferred through individual linear graphite pieces to the glass raw material 14 existing in the circumferential portion on the traverse plane. Therefore, the radioactive waste 13, glass raw material 14, and graphite existing in the adiabatic area are further less likely to be non-uniformly heated, so that the respective temperatures of the radioactive waste 13, glass raw material 14, and graphite in the solidifying vessel 10 become more uniform on the traverse plane of the solidifying vessel 10. This suppresses corrosion of the solidifying vessel 10 and volatilization of radioactive substance including in the radioactive waste 13 at high temperatures. In addition, the vitrified radioactive waste 16, in which the radioactive waste 13 is uniform, is obtained. This vitrified radioactive waste 16 is stable.

In the present embodiment, heat is efficiently transferred from the central portion on the traverse plane of the solidifying vessel 10 to the circumferential portion on the traverse plane due to the effect of the graphite in the solidifying vessel 10, so that the glass raw material 14 existing in the circumferential portion, in which temperature would otherwise be likely to be low, can be melted faster. As a result, a time taken to produce the vitrified radioactive waste 16 can be further shortened.

In the present embodiment, thermal energy is efficiently transferred through graphite, the thermal energy being generated when radiation emitted as a result of the decay of radioactive nuclides included in the radioactive waste 13 in the solidifying vessel 10 is absorbed. Particularly, heat is transferred from the central portion on the traverse plane of the solidifying vessel 10 to the circumferential portion on the traverse plane. Therefore, the radioactive waste 13 and glass raw material 14 in the solidifying vessel 10 are efficiently heated. In the present embodiment, therefore, a melting facility to melt the glass raw material 14 is not needed, unlike solidification of radioactive waste with glass, which is described in Japanese Patent Laid-Open No. 2011-46996. That is, a simple system can be used to solidify the radioactive waste 13 with the glass raw material 14.

In the present embodiment, zeolite to which Cs-137 was adsorbed was supplied into the solidifying vessel 10 as the radioactive waste 13 and was solidified with the glass raw material 14. In the present embodiment, however, clinoptilolite, mordenitem, chabazite, insoluble ferrocyanide, or a titanate compound may be supplied into the solidifying vessel 10 and may be solidified by melting the glass raw material 14, as the radioactive waste 13.

As substitute for soda lime glass, either silicate glass or borosilicate glass may be used as the glass raw material 14. Furthermore, as the glass raw material 14, any one of lead glass, phosphate glass, and vanadium-based glass, which have a softening point lower than soda lime glass, silicate glass, and borosilicate glass may be used. When one of lead glass, phosphate glass, and vanadium-based glass is used, solidification with glass is possible in an area at a lower temperature. Therefore, even under conditions in which the amount of heat generated by the decay of radioactive nuclides (for example, cesium 137) included in the radioactive waste 13 supplied in the solidifying vessel 10 is low and in which a highly adiabatic state cannot be assured, the radioactive waste 13 can be solidified with glass in the solidifying vessel 10 and volatilization of the radioactive substance including in the radioactive waste 13 can be suppressed to a lower level.

Glass wool used in the adiabatic vessel 12 and lid 12A used in adiabatic processing in the present embodiment may be replaced with any one of cellulose fiber, which is a fiber-based adiabatic material, carbonized cork, urethane foam, phenol foam, polystyrene foam, and a potassium silicate board, which is a porous adiabatic material. These adiabatic materials may be used in the adiabatic vessel 12 and lid 12A in embodiments 2 and 4 described below.

Embodiment 2

A radioactive waste solidification method according to embodiment 2, which is other preferred embodiment of the present invention, will be described with reference to FIGS. 1 and 2. In the radioactive waste solidification method according to the present embodiment, 100 kg of high-dose radioactive waste that includes $10^{16}$ Bq of Sr-90 (for example, a spent adsorbent, for radioactive nuclides, whose main component is a titanate compound to which Sr-90 was adsorbed (the adsorbent will be referred to be below as the titanate compound adsorbent)), 100 kg of borosilicate glass, which is a glass raw material, with a glass softening point of approximately 800° C., and 20 kg of linear graphite were supplied into a solidifying vessel and a vitrified radioactive waste is produced. The radioactive waste solidification method in the present embodiment will be described below.

In the present embodiment as well, the vitrified radioactive waste 16 is produced in steps S1, S2, and S3, as in the embodiment 1.

In step S1, 100 kg of high-dose radioactive waste 13, including $10^{16}$ Bq of Sr-90, stored in the waste tank 1 and 100 kg of borosilicate glass, which is glass raw material 14, stored in the glass raw material tank 3 were supplied into the solidifying vessel 10. In the present embodiment, the radioactive waste 13 supplied into the solidifying vessel 10 is a titanate compound adsorbent to which Sr-90 was adsorbed. The solidifying vessel 10 filled with the radioactive waste 13 and glass raw material 14 is moved to a position immediately below the graphite tank 5 filled with graphite. The graphite in the graphite tank 5 is supplied into the solidifying vessel 10 while the radioactive waste 13 and glass raw material (borosilicate glass) 14 are being mixed in the solidifying vessel 10 by being agitated with the agitator 11. The radioactive waste 13, glass raw material (borosilicate glass) 14, and graphite in the solidifying vessel 10 are mixed by being agitated with the agitator 11.

After the radioactive waste 13, glass raw material 14, and graphite were supplied into the solidifying vessel 10, step S2 is executed. That is, as in the embodiment 1, the solidifying vessel 10 in which the radioactive waste 13, glass raw material 14, and graphite were stored is disposed in the adiabatic vessel 12, and the lid 12A is attached to the adiabatic vessel 12 to seal it. Radiation emitted by the decay of Sr-90 included in the radioactive waste 13 existing in the solidifying vessel 10 surrounded with the lid 12A and adiabatic vessel 12 is absorbed by the radioactive waste 13, glass raw material 14, and graphite in the solidifying vessel 10 and is then converted to thermal energy. This thermal energy heats the radioactive waste 13 and glass raw material 14 surrounded with the lid 12A and adiabatic vessel 12, so their temperatures are raised. Particularly, since the thermal energy is efficiently transferred to the glass raw material 14 through the graphite, the glass raw material 14 in the solidifying vessel 10 is heated and melted. The respective temperatures of the radioactive waste 13 and glass raw material 14 in the solidifying vessel 10 surrounded with the lid 12A and adiabatic vessel 12 become substantially uniform; these temperatures do not become non-uniform depending on the positions of the radioactive waste 13 and glass raw material 14 in the solidifying vessel 10. An adiabatic area is formed in the sealed adiabatic vessel 12 as described above. In the present embodiment as well, the solidifying vessel 10 filled with the radioactive waste 13, glass raw material 14, and graphite is disposed in this adiabatic area.

Since the solidifying vessel 10 is disposed in the adiabatic vessel 12 and graphite exists in the solidifying vessel 10, the temperature in the circumferential portion on the traverse plane of the solidifying vessel 10 is raised by the effects of the adiabatic vessel 12. In addition, due to the effect of the graphite, heat that is stored at the central portion on the traverse plane is easily transferred to the circumferential portion on the traverse plane. Accordingly, the temperature of the circumferential portion is further raised. As a result, the difference in temperature between the central portion and circumferential portion on the traverse plane is further reduced, enabling the glass raw material 14 existing in the circumferential portion is melted fast.

For example, Sr-90 emits approximately 2.8 MeV of energy per disintegration. If this radiation is absorbed in the radioactive waste 13, glass raw material 14, and graphite in the solidifying vessel 10, and the radiation is converted to thermal energy. Since the radioactive waste 13 includes $10^{16}$ Bq of Sr-90, if radiation emitted from each Sr-90 is all absorbed in the radioactive waste 13, glass raw material 14, and graphite in the solidifying vessel 10, thermal energy of 2.8 MeV$\times 10^{16}$ Bq=2.8 E22 eV/s, that is, at a heat generation rate of 4520 J/s is obtained. If the specific heat of the mixture 15 of the radioactive waste (titanate compound adsorbent to which Sr-90 was adsorbed) and glass raw material (borosilicate glass) 14 is 0.5 J/(g·K), the respective temperatures of the radioactive waste 13, glass raw material 14, and graphite are raised by approximately 160° C. per hour. Borosilicate glass, which is the glass raw material 14, is melted due to this temperature rise and flows into clearances formed among the radioactive waste 13, graphite, and the like.

In step S3, the vitrified radioactive waste 16 is produced. Specifically, since some heat is emitted to the outside through the adiabatic vessel 12 and lid 12A, an actual temperature rise rate in the solidifying vessel 10 is lower than 160° C./h. However, a temperature rise is continued with time, so all glass raw materials 14 are melted. As a result, clearances formed among the radioactive waste 13, graphite, and the like are filled with the melted substance of the glass raw material 14. As a time elapses, the glass raw material 14 melted among the radioactive waste 13 and graphite coagulates, and the glass-solidified substance 31 is produced in the solidifying vessel 10. The glass-solidified substance 31 includes the radioactive waste 13 and graphite, which were combined together by the coagulated glass raw material (borosilicate glass) 14. Then, the solidifying vessel 10, in which the glass-solidified substance 31 was formed, is taken out from the adiabatic vessel 12. A lid (not shown) is attached to the upper end of the solidifying vessel 10, which internally includes the glass-solidified substance 31, to seal the solidifying vessel 10, producing the vitrified radioactive waste 16. The vitrified radioactive waste 16 is stored in a prescribed storage place (not shown).

The present embodiment can obtain the effects generated in the embodiment 1.

As substitute for borosilicate glass, any one of glasses described in the embodiment 1 may be used as the glass raw material 14. In the present embodiment, the radioactive waste 13 to be solidified with the glass raw material 14 may be zeolite, clinoptilolite, mordenitem, chabazite, or insoluble ferrocyanide, besides a titanate compound adsorbent.

Embodiment 3

Figure 3:
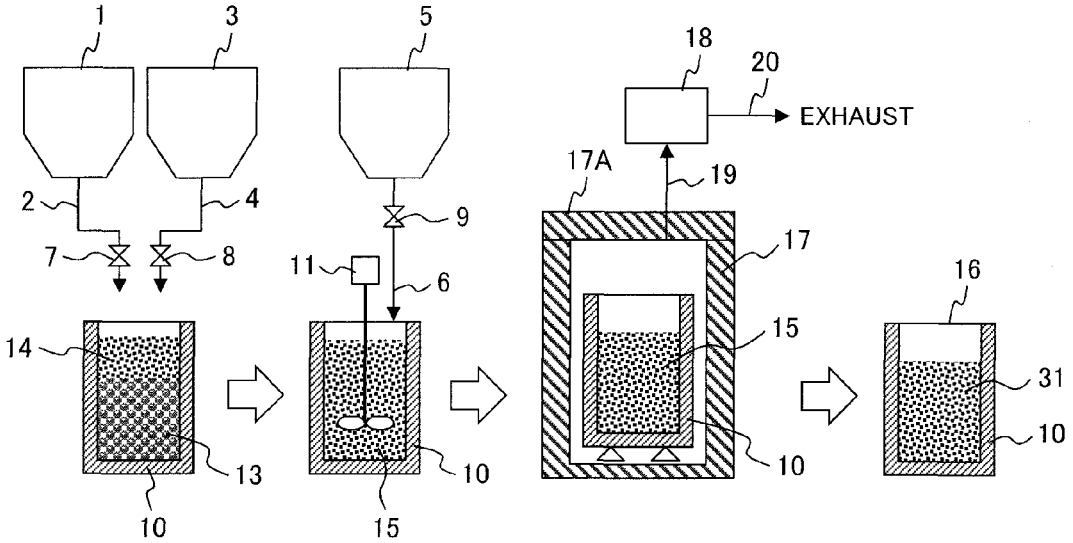
FIG. 3 is an explanatory drawing showing a radioactive waste solidification method according to embodiment 3, which is other preferred embodiment of the present invention.

A radioactive waste solidification method according to embodiment 3, which is other preferred embodiment of the present invention, will be described with reference to FIGS. 1 and 3. In the radioactive waste solidification method according to the present embodiment, to create a vitrified radioactive waste, 100 kg of high-dose radioactive waste that includes $10^{15}$ Bq of Cs-137 (for example, a spent adsorbent, for radioactive nuclides, whose main component is insoluble ferrocyanide and to which Cs-137 was adsorbed (the adsorbent will be referred to be below as the insoluble ferrocyanide compound adsorbent)), 100 kg of vanadium-based glass, which is a glass raw material, with a glass softening point of approximately 300° C., and 20 kg of linear graphite were supplied into a solidifying vessel 10 and a vitrified radioactive waste is produced. The radioactive waste solidification method according to the present embodiment will be described below.

In the present embodiment as well, the vitrified radioactive waste 16 is produced in steps S1, S2 and S3, as in the embodiment 1. In adiabatic processing in step S2 according to the present embodiment, however, a pressure reducing vessel (second vessel) 17 is used instead of the adiabatic vessel 12 used in step S2 in embodiments 1 and 2.

In the present embodiment, 100 kg of insoluble ferrocyanide compound adsorbent, which is the radioactive waste 13 supplied from the waste tank 1, and 100 kg of vanadium-based glass, which is the glass raw material 14 supplied from the glass raw material tank 3, are supplied into the solidifying vessel (first vessel) 10 in step S1. The solidifying vessel 10 is then disposed in a pressure reducing vessel 17 in step S2. A lid 17A is attached to the pressure reducing vessel 17 to seal it.

An exhaust pipe 19 is connected between the pressure reducing vessel 17 and a pressure reducing pump 18. In addition, an exhaust pipe 20 is connected to the pressure reducing pump 18. In step S2, the pressure in the sealed pressure reducing vessel 17 is reduced as described below.

The lid 17A is attached to the pressure reducing vessel 17 to seal it, after which an opening and closing valve (not shown) attached to the exhaust pipe 19 is opened and the pressure reducing pump 18 is driven. Then, the gas in the sealed pressure reducing vessel 17, in which the solidifying vessel 10 is disposed, is released to the outside through the exhaust pipes 19 and 20 until the pressure in the pressure reducing vessel 17 drops to one-tenth of the atmospheric pressure. When the pressure in the pressure reducing vessel 17 becomes one-tenth of the atmospheric pressure, the pressure reducing pump 18 is stopped and the opening and closing valve attached to the exhaust pipe 19 is closed. When the pressure in the sealed pressure reducing vessel 17, which surrounds the solidifying vessel 10 filled with the radioactive waste (for example, an insoluble ferrocyanide compound adsorbent) 13, glass raw material (vanadium-based glass) 14, and graphite, is reduced to one-tenth of the atmospheric pressure, adiabatic performance is improved by a factor of approximately 10.

When the pressure in the sealed pressure reducing vessel 17 is reduced, an adiabatic area at a reduced pressure is formed in the pressure reducing vessel 17. The solidifying vessel 10 filled with the radioactive waste 13, glass raw material 14, and graphite is disposed in the adiabatic area in the sealed pressure reducing vessel 17.

When the solidifying vessel 10 is thermally insulated by pressure reduction as described above, radiation generated due to the decay of Cs-137 included in the radioactive waste 13 in the solidifying vessel 10 is absorbed by the radioactive waste 13, glass raw material 14, and graphite in the solidifying vessel 10 and is then converted to thermal energy. This thermal energy heats the radioactive waste 13, glass raw material 14, and graphite, which are surrounded with the lid 17A and pressure reducing vessel 17 and exist in the area at a reduced pressure (adiabatic area). Furthermore, since heat is efficiently transferred to the glass raw material 14 through the graphite, the respective temperatures of the radioactive waste 13, glass raw material 14, and graphite in the solidifying vessel 10 are raised. Therefore, heat is efficiently transferred from the central portion on the traverse plane of the solidifying vessel 10 to the circumferential portion on the traverse plane through the graphite. This further reduces the difference in temperature between the central portion and circumferential portion on the traverse plane of the solidifying vessel 10. Therefore, the temperatures of the radioactive waste 13, glass raw material 14, and graphite in the solidifying vessel 10 are less likely to become non-uniform depending on their positions in the solidifying vessel 10. That is, these temperatures are substantially uniform.

For example, Cs-137 emits radiation with approximately 1.15 MeV of energy per disintegration, as described in the embodiment 1. When this radiation is absorbed in the radioactive waste 13, glass raw material 14, and graphite in the solidifying vessel 10, the radiation is converted to thermal energy. Since the radioactive waste 13 includes $10^{15}$ Bq of Cs-137, if radiation emitted from each Cs-137 is all absorbed in the radioactive waste 13, glass raw material 14, and graphite in the solidifying vessel 10, thermal energy of 1.15 MeV× $10^{15}$ Bq=1.15E21 eV/s, that is, at a heat generation rate of 184 J/s, is obtained. If the specific heat of the mixture 15 of the radioactive waste (an insoluble ferrocyanide compound adsorbent to which Cs-137 was adsorbed) 13, glass raw material (vanadium-based glass) 14, and graphite is 0.5 J/(g·K), the respective temperatures of the radioactive waste 13 and glass raw material 14 are raised by approximately 6.6° C. per hour.

In step S3, the vitrified radioactive waste 16 is produced. Specifically, since some heat is emitted to the outside through the adiabatic vessel 12 and lid 12A, an actual temperature rise rate in the solidifying vessel 10 is lower than 6.6° C./h. However, a temperature rise is continued with time, so that all glass raw materials 14 are melted. As a result, clearances formed among the radioactive waste 13, graphite, and the like are filled with the melted substance of the glass raw material 14. As a time elapses, the glass raw material 14 melted among the radioactive waste 13 and graphite coagulates, and the glass-solidified substance 31 is produced in the solidifying vessel 10. The glass-solidified substance 31 includes the radioactive waste 13 and graphite, which were combined together by the coagulated glass raw material (vanadium-based glass) 14. Then, the solidifying vessel 10, in which the glass-solidified substance 31 was formed, is taken out from the adiabatic vessel 12. A lid (not shown) is attached to the upper end of the solidifying vessel 10, which internally includes the glass-solidified substance 31, to seal the solidifying vessel 10, producing the vitrified radioactive waste 16. The vitrified radioactive waste 16 is stored in a prescribed storage place (not shown).

The present embodiment can obtain the effects generated in the embodiment 1. Particularly, in the present embodiment, the radioactive waste 13, glass raw material 14, and graphite existing in the adiabatic area in the sealed pressure reducing vessel 17 are further less likely to be non-uniformly heated, so that the temperatures of the radioactive waste 13 and glass raw material 14 in the solidifying vessel 10 become more uniform. Furthermore, in the present embodiment, the solidifying vessel 10 including the radioactive waste 13, glass raw material 14, and graphite is disposed in the sealed pressure reducing vessel 17 and the pressure in the pressure reducing vessel 17 is reduced, so a desired adiabatic effect can be obtained by adjusting the degree of pressure reduction.

As substitute for vanadium-based glass, any one of the glasses described in the embodiment 1 may be used as the glass raw material 14. In the present embodiment, the radioactive waste 13 to be solidified with the glass raw material 14 may be zeolite, clinoptilolite, mordenitem, chabazite, or a titanate compound, besides an insoluble ferrocyanide compound adsorbent.

Embodiment 4

Figure 4:
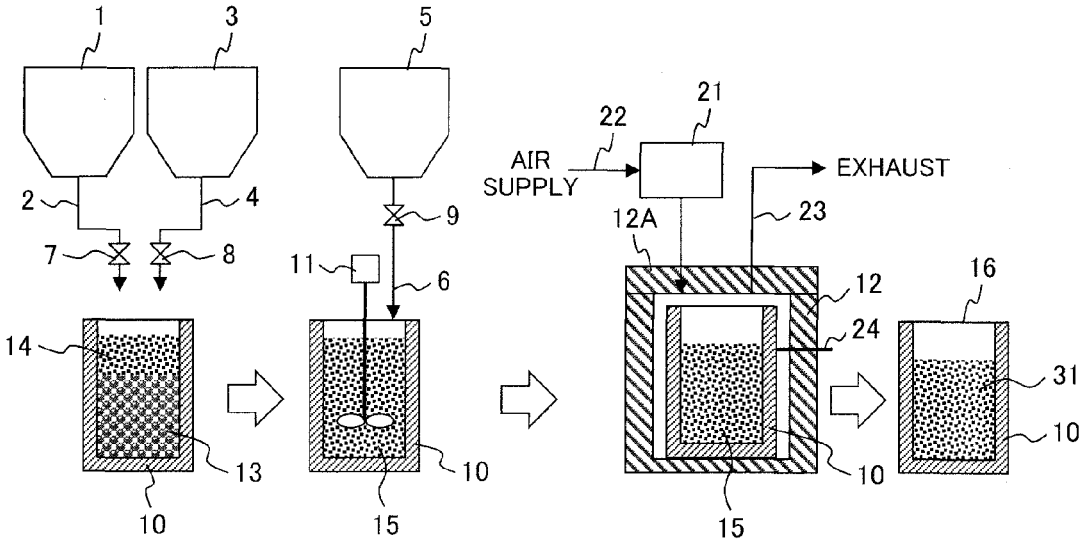
FIG. 4 is an explanatory drawing showing a radioactive waste solidification method according to embodiment 4, which is other preferred embodiment of the present invention.

A radioactive waste solidification method according to embodiment 4, which is other preferred embodiment of the present invention, will be described with reference to FIGS. 1 and 4. In the radioactive waste solidification method according to the present embodiment, 100 kg of as high-dose radioactive waste that includes $10^{15}$ Bq of Co-60 (for example, a solid-state waste whose main component is an iron oxide including Co-60 (the waste will be referred to as the iron oxide)), 100 kg of soda lime glass, which is a glass raw material, with a glass softening point of approximately 700° C., and 20 kg of linear graphite were supplied into a solidifying vessel 10 and a vitrified radioactive waste 16 is produced. The radioactive waste solidification method according to the present embodiment will be described below.

In the present embodiment as well, the vitrified radioactive waste 16 is produced in steps S1, S2 and S3, as in the embodiment 1. In adiabatic processing in step S2 in the present embodiment, however, an adiabatic vessel 12 to which an air supply pipe having an air supply pump and an exhaust pipe are connected is used instead of the adiabatic vessel 12 used in steps S2 in embodiments 1 and 2.

In the present embodiment, 100 kg of iron oxide which is the radioactive waste 13 supplied from the waste tank 1, 100 kg of soda lime glass which is the glass raw material 14 supplied from the glass raw material tank 3, and 20 kg of graphite supplied from the graphite tank 5 are supplied into the solidifying vessel 10 in step S1, as with the radioactive waste 13, glass raw material 14, and graphite in the embodiment 1. The radioactive waste 13, glass raw material 14, and graphite are mixed with the agitator 11 in the solidifying vessel 10.

After that, adiabatic processing in step S2 is performed on the solidifying vessel 10 filled with the radioactive waste 13, glass raw material 14 (soda lime glass), and graphite. The solidifying vessel 10 filled with the radioactive waste 13, glass raw material 14, and graphite is disposed in the adiabatic vessel 12 in step S2. After the solidifying vessel 10 has been disposed, the lid 12A is attached to the adiabatic vessel 12 to seal it. An air supply pipe 22 having an air supply pump 21 and an opening and closing valve (not shown) and an exhaust pipe 23 having an opening and closing valve (not shown) are connected to the adiabatic vessel 12, respectively. A thermometer 24 is attached to the adiabatic vessel 12.

Radiation generated due to the decay of Co-60 included in the radioactive waste 13 existing in the solidifying vessel 10 surrounded by the sealed adiabatic vessel 12 is absorbed in the radioactive waste 13, glass raw material 14, and graphite in the solidifying vessel 10 and is then converted to thermal energy. This thermal energy heats the radioactive waste 13, glass raw material 14, and graphite, which are surrounded with the lid 12A and adiabatic vessel 12, so that their temperatures are raised. Furthermore, since heat is efficiently transferred to the glass raw material 14 through the graphite, the temperatures of the radioactive waste 13, glass raw material 14, and graphite in the solidifying vessel 10 are raised. Therefore, heat is efficiently transferred from the central portion on the traverse plane of the solidifying vessel 10 to the circumferential portion on the traverse plane through the graphite. This further reduces the difference in temperature between the central portion and circumferential portion on the traverse plane of the solidifying vessel 10. Therefore, the temperatures of the radioactive waste 13 and glass raw material 14 in the solidifying vessel 10 are less likely to become non-uniform depending on their positions in the solidifying vessel 10. That is, these temperatures are substantially uniform.

For example, Co-60 emits radiation with approximately 2.5 MeV of energy per disintegration. When this radiation is absorbed in the radioactive waste 13, glass raw material 14, and graphite in the solidifying vessel 10, the radiation is converted to thermal energy. Since the radioactive waste 13 includes $10^{15}$ Bq of Co-60, if radiation emitted from each Co-60 is all absorbed in the radioactive waste 13, glass raw material 14, and graphite in the solidifying vessel 10, thermal energy of 2.5 MeV$\times 10^{15}$ Bq=2.5 E22 eV/s, that is, at a heat generation rate of 4000 J/s, is obtained. If the specific heat of the mixture 15 of the radioactive waste (iron oxide including Co-60) 13, glass raw material (soda lime glass) 14, and graphite is 0.5 J/(g·K), the respective temperatures of the radioactive waste 13, glass raw material 14, and graphite are raised by approximately 144° C. per hour.

In step S3, the vitrified radioactive waste 16 is produced. Specifically, since some heat is emitted to the outside through the adiabatic vessel 12 and lid 12A, an actual temperature rise rate in the solidifying vessel 10 is lower than 144° C./h. However, a temperature rise is continued with time, so that all glass raw materials 14 are melted. At that time, the temperature of the solidifying vessel 10 in the adiabatic vessel 12 is measured with the thermometer 24. When the temperature of the solidifying vessel 10 reaches 800° C., which is suitable for the melting of the glass raw material (soda lime glass) 14, in order to prevent the temperature of the solidifying vessel 10 from being further raised, the opening and closing valve attached to the air supply pipe 22 and the opening and closing valve attached to the exhaust pipe 23 are opened and the air supply pump 21 is driven to supply an external gas (air) to the interior of the adiabatic vessel 12 through the air supply pipe 22, so that the temperature of the solidifying vessel 10 is maintained at an appropriate temperature. The air supplied into the adiabatic vessel 12 is exhausted to the outside of the adiabatic vessel 12 through the exhaust pipe 23. The amount of air to be supplied into the adiabatic vessel 12 can be adjusted by controlling the rotational speed of the air supply pump 21 based on the temperature of the solidifying vessel 10.

As a result, clearances formed among the radioactive waste 13, graphite, and the like are filled with the melted substance of the glass raw material 14. As a time elapses, the glass raw material 14 melted among the radioactive waste 13 and graphite coagulates, and the glass-solidified substance 31 is produced in the solidifying vessel 10. The glass-solidified substance 31 includes the radioactive waste 13 and graphite, which were combined together by the coagulated glass raw material (soda lime glass) 14. Then, the solidifying vessel 10, in which the glass-solidified substance 31 was formed, is taken out from the adiabatic vessel 12. A lid (not shown) is attached to the upper end of the solidifying vessel 10, which internally includes the glass-solidified substance 31, to seal the solidifying vessel 10, producing the vitrified radioactive waste 16. The vitrified radioactive waste 16 is stored in a prescribed storage place (not shown).

The present embodiment can obtain the effects generated in the embodiment 1. In addition, in the present embodiment, the amount of gas (for example, air) to be supplied into the adiabatic vessel 12 is adjusted based on the measured temperature of the solidifying vessel 10 in the adiabatic vessel 12, so that it is possible to prevent the respective temperatures of the radioactive waste 13 and glass raw material 14 in the solidifying vessel 10, which are raised by heat generated due to the decay of radioactive nuclides (for example, Co-60), from exceeding a temperature necessary for glass solidification. Therefore, the evaporation of radioactive nuclides included in the radioactive waste 13 can be suppressed.

During solidification with the melted glass raw material 14 as well, the amount of gas to be supplied into the adiabatic vessel 12 can also be adjusted based on the measured temperature of the solidifying vessel 10. Therefore, since the temperature during solidification with glass is measured and the amount of gas to be supplied is controlled accordingly, a rate at which the glass raw material 14 is cooled can be adjusted. This can suppress the vitrified radioactive waste 16 from being cracked due to thermal distortion.

As substitute for soda lime glass, any one of the glasses described in the embodiment 1 may be used as the glass raw material 14. In the present embodiment, the radioactive waste 13 to be solidified with the glass raw material 14 may be zeolite, clinoptilolite, mordenitem, chabazite, an insoluble ferrocyanide compound, or a titanate compound, besides iron oxides.

Embodiment 5

Figure 5:
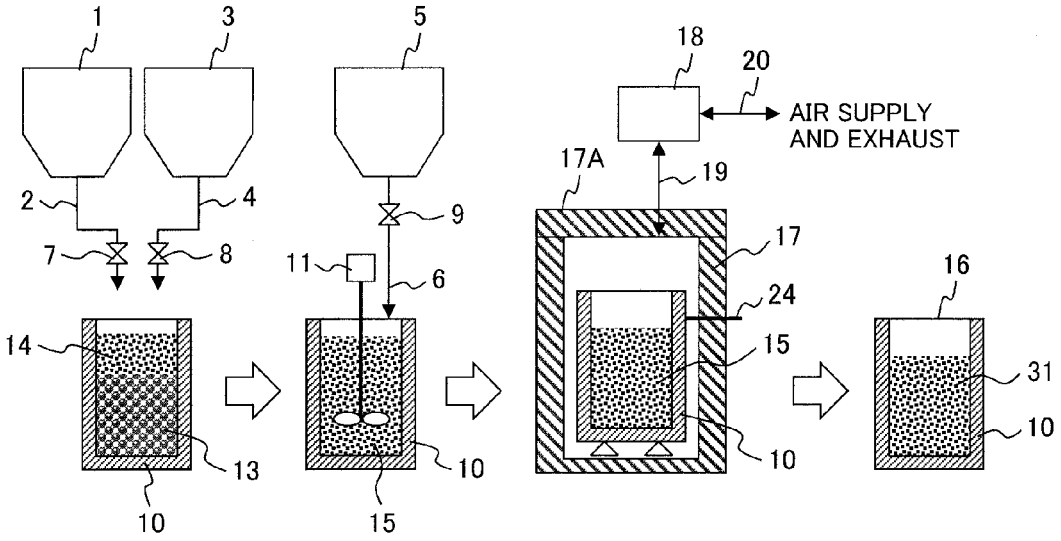
FIG. 5 is an explanatory drawing showing a radioactive waste solidification method according to embodiment 5, which is other preferred embodiment of the present invention.

A radioactive waste solidification method according to embodiment 5, which is other preferred embodiment of the present invention, will be described with reference to FIG. 5. In the radioactive waste solidification method according to the present embodiment, 100 kg of high-dose radioactive waste that includes $10^{16}$ Bq of Cs-137 (for example, zeolite to which Cs-137 was adsorbed), 300 kg of soda lime glass, which is a glass raw material, with a glass softening point of approximately 700° C., and 20 kg of graphite were supplied into a solidifying vessel 10 and a vitrified radioactive waste 16 is produced. The radioactive waste solidification method according to the present embodiment will be described below.

In the present embodiment as well, the vitrified radioactive waste 16 is produced in steps S1, S2 and S3, as in the embodiment 1. In the present embodiment, however, the radioactive waste 13 and glass raw material 14 are supplied into the solidifying vessel 10 at the same time in step S1 and, in adiabatic processing in step S2, the pressure reducing vessel 17 is used as in the embodiment 3.

In the present embodiment, 100 kg of high-dose radioactive waste 13 including $10^{16}$ Bq of Cs-137 supplied from the waste tank 1, 300 kg of glass raw material 14 supplied from the glass raw material tank 3, and 20 kg of graphite supplied from the graphite tank 5, are supplied into the solidifying vessel 10 in step S1, as in the embodiment 1. The radioactive waste 13 is a spent adsorbent whose main component is zeolite and to which Cs-137 was adsorbed. The glass raw material 14 is soda lime glass. The radioactive waste 13, glass raw material 14, and graphite are mixed in the solidifying vessel 10 with the agitator 11. For convenience, a mixture of the radioactive waste 13, glass raw material 14, and graphite will be referred to as the mixture 15. The size of the solidifying vessel 10 used in the present embodiment is large enough to store 100 kg of radioactive waste 13, 300 kg of glass raw material 14, and 20 kg of graphite.

The solidifying vessel 10 filled with the mixture 15 is disposed in the pressure reducing vessel 17 in step S2, as in the embodiment 3. The thermometer 24 is attached to the pressure reducing vessel 17. The lid 17A is attached to the pressure reducing vessel 17 to seal it. After that, the pressure reducing pump 18 is driven and the pressure in the sealed pressure reducing vessel 17 is reduced to one-tenth of the atmospheric pressure, as in the embodiment 3.

In a state in which the solidifying vessel 10 filled with the radioactive waste 13, glass raw material 14, and graphite is disposed in an ambient atmosphere that is surrounded with the lid 17A and pressure reducing vessel 17 under reduced pressure, the radioactive waste 13, glass raw material 14, and graphite in the solidifying vessel 10 are heated by thermal energy generated due to the decay of Cs-137 included in the radioactive waste 13. The temperatures of the radioactive waste 13, glass raw material 14, and graphite in the solidifying vessel 10, which is thermally insulated from the outside, are thereby raised. Furthermore, since heat is efficiently transferred to the glass raw material 14 through the graphite, the temperatures of the radioactive waste 13, glass raw material 14, and graphite in the solidifying vessel 10 are raised. Therefore, heat is efficiently transferred from the central portion on the traverse plane of the solidifying vessel 10 to the circumferential portion on the traverse plane through the graphite. This further reduces the difference in temperature between the central portion and circumferential portion on the traverse plane of the solidifying vessel 10. Therefore, the temperatures of the radioactive waste 13 and glass raw material 14 in the solidifying vessel 10 are less likely to become non-uniform depending on their positions in the solidifying vessel 10. That is, these temperatures are substantially uniform.

When this state is maintained, the glass raw material 14 in the solidifying vessel 10 is melted and enters clearances formed among the radioactive waste 13, graphite, and the like. When the temperature of the solidifying vessel 10, which is measured with the thermometer 24, is raised to a temperature suitable for the melting of the glass raw material 14, the pressure in the pressure reducing vessel 17 is controlled by supplying air to and exhausting air from the pressure reducing vessel 17 with the pressure reducing pump 18 in order to prevent the temperature of the solidifying vessel 10, that is, the temperatures of the glass raw material 14, from being further raised beyond the temperature suitable for the melting. As a result, the temperature of the glass raw material 14 is maintained at an appropriate temperature.

For example, Cs-137 emits radiation with approximately 1.15 MeV of energy per disintegration, as described above. When the radioactive waste 13 includes $10^{16}$ Bq of Cs-137, therefore, thermal energy at a heat generation rate of 1840 J/s is obtained. If the specific heat of the mixture 15 of the radioactive waste (zeolite to which Cs-137 has been adsorbed) 13, glass raw material (soda lime glass) 14, and graphite is 0.5 J/(g·K), the respective temperatures of the radioactive waste 13 and glass raw material 14 are raised by approximately 33° C. per hour.

In step S3, the vitrified radioactive waste 16 is produced. Specifically, a temperature rise is continued with time, so that all glass raw materials 14 are melted. As a result, clearances formed among the radioactive waste 13, graphite, and the like are filled with the melted substance of the glass raw material 14. As a time elapses, the glass raw material 14 melted among the radioactive waste 13 and graphite coagulates, and the glass-solidified substance 31 is produced in the solidifying vessel 10. The glass-solidified substance 31 includes the radioactive waste 13 and graphite, which was combined together by the coagulated glass raw material (soda lime glass) 14. Then, the solidifying vessel 10, in which the glass-solidified substance 31 was formed, is taken out from the adiabatic vessel 12. A lid (not shown) is attached to the upper end of the solidifying vessel 10, which internally includes the glass-solidified substance 31, to seal the solidifying vessel 10, producing the vitrified radioactive waste 16. The vitrified radioactive waste 16 is stored in a prescribed storage place (not shown).

The present embodiment can obtain the effects generated in the embodiment 3. Since, in the present embodiment, the state of reduction in pressure in the pressure reducing vessel 17 is controlled based on the temperature of the solidifying vessel 10 that is measured during solidification with glass, temperature in solidification with glass can be controlled to a desired value. Furthermore, cooling temperature after glass was melted is controlled, so that it becomes also possible to suppress the vitrified radioactive waste 16 from being cracked due to thermal distortion.

Embodiment 6

Figure 6:
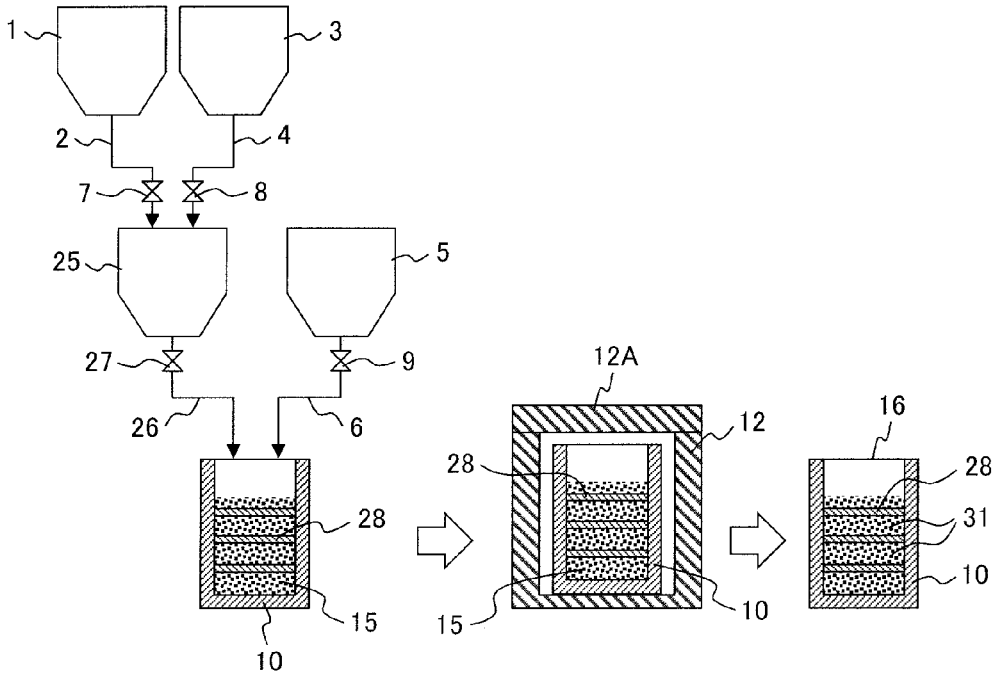
FIG. 6 is an explanatory drawing showing a radioactive waste solidification method according to embodiment 6, which is other preferred embodiment of the present invention.

A radioactive waste solidification method according to embodiment 6, which is other preferred embodiment of the present invention, will be described with reference to FIG. 6. In the radioactive waste solidification method according to the present embodiment, 100 kg of high-dose radioactive waste that includes $10^{16}$ Bq of Cs-137 (for example, zeolite to which Cs-137 was adsorbed), 100 kg of soda lime glass, which is a glass raw material, with a glass softening point of approximately 700° C., and 20 kg of graphite were supplied into a solidifying vessel 10 and a vitrified radioactive waste 16 is produced. The radioactive waste solidification method according to the present embodiment will be described below.

In the present embodiment as well, the vitrified radioactive waste 16 is produced in steps S1, S2 and S3, as in the embodiment 1. However, the present embodiment differs from the embodiment 1 in the way in which the solidifying vessel 10 is filled with the radioactive waste 13, glass raw material 14, and graphite in step S1.

In step S1, 100 kg of high-dose radioactive waste (zeolite to which Cs-137 was adsorbed) 13, which includes $10^{16}$ Bq of Cs-137, in the waste tank 1 is first supplied into the mixing tank 25 through the waste supply pipe 2 connected to the waste tank 1 by opening the opening and closing valve 7. In addition, 100 kg of soda lime glass, which is a glass raw material 14, in the glass raw material tank 3, is supplied into a mixing tank 25 through the glass raw material supply pipe 4 by opening the opening and closing valve 8. After the radioactive waste 13 and glass raw material 14 was supplied into the mixing tank 25 by their predetermined amounts, the opening and closing valves 7 and 8 are closed. The radioactive waste 13 and glass raw material 14 are mixed in the mixing tank 25 with an agitator (not shown).

A vacant solidifying vessel 10 is moved to the vicinity of a position immediately below the mixing tank 25 and graphite tank 5. The mixture 15 of the radioactive waste 13 and glass raw material 14 in the mixing tank 25 is supplied into the solidifying vessel 10 through a supply pipe 26 by opening an opening and closing valve 27 installed to the supply pipe 26. After a predetermined amount of mixture 15 was supplied into the solidifying vessel 10, the opening and closing valve 27 is closed to stop the supply of the mixture 15 into the solidifying vessel 10. A layer of the mixture 15 with a prescribed height is formed on a bottom of the solidifying vessel 10 due to this supply of the mixture 15 into the solidifying vessel 10. After that, a predetermined amount of linear graphite in the graphite tank 5 is supplied on the layer of the mixture 15 in the solidifying vessel 10 through the graphite supply pipe 6 by opening the opening and closing valve 9. A graphite layer 28 with a predetermined thickness is formed on the layer of the mixture 15 in the solidifying vessel 10 due to the supply of graphite. To form the graphite layer 28 with a predetermined thickness on the layer of the mixture 15, it is desirable to form a lower portion of the graphite supply pipe 6, which is below the opening and closing valve 9, with a flexible hose made of a substance resistant to radiation. When the lower end of the hose is swiveled in the solidifying vessel 10 at its upper end, the graphite can be supplied on the layer of the mixture 15 so that the thickness of the graphite is even. When the graphite layer 28 with a predetermined thickness was formed on the mixture 15, the opening and closing valve 9 is closed to stop the supply of the graphite into the solidifying vessel 10. After that, the opening and closing valve 27 and opening and closing valve 9 are repeatedly opened and closed to alternately form the layer of the mixture 15 and graphite layer 28 in the solidifying vessel 10 in the axial direction of the solidifying vessel 10.

The process to form the layer of the mixture 15 in the solidifying vessel 10 is terminated when the mixing tank 25 filled with the mixture 15 of 100 kg of radioactive waste 13 and 100 kg of glass raw material 14 has been emptied as a result of supplying it into the solidifying vessel 10. The process to form the graphite layer 28 in the solidifying vessel 10 is terminated when the graphite tank 5 filled with 20 kg of graphite in has been emptied as a result of supplying it into the solidifying vessel 10. It is preferable to supply 20 kg of graphite into the graphite tank 5 in advance.

After the predetermined amount of mixture 15 and the predetermined amount of graphite have been supplied into the solidifying vessel 10 and the layer of the mixture 15 and graphite layer 28 have been formed, steps S2 and S3 in the embodiment 1 are executed for the solidifying vessel 10. Specifically, in step S2 in the present embodiment, the solidifying vessel 10, in which the layer of the mixture 15 and graphite layer 28 have been alternately formed in the solidifying vessel 10 in an axial direction of the solidifying vessel 10, is disposed in the adiabatic vessel 12, after which the lid 12A is attached to the adiabatic vessel 12 to seal it. Then, adiabatic processing is performed for the solidifying vessel 10 in step S2, as in step S2 in the embodiment 1, to melt the glass raw material (soda lime glass) in the solidifying vessel 10. In step S2, heat transfer on the traverse plane of the solidifying vessel 10 from the central portion on the traverse plane to the circumferential portion on the traverse plane occurs through the graphite layer 28. Therefore, soda lime glass, which is the glass raw material 14, existing in the circumferential portion on the traverse plane of the solidifying vessel 10 is melted fast.

In step S3 in the present embodiment, clearances formed among the radioactive waste 13, graphite, and the like are filled with the melted substance of the glass raw material 14. As a time elapses, the glass raw material 14 melted among the radioactive waste 13 and graphite coagulates, and the glass-solidified substance 31 is produced in the solidifying vessel 10. The glass-solidified substance 31 includes the radioactive waste 13 and graphite, which were combined together by the coagulated glass raw material (soda lime glass) 14. Then, the lid 12A is removed from the adiabatic vessel 12, and the solidifying vessel 10, in which the glass-solidified substance 31 was formed, is taken out from the adiabatic vessel 12. A lid (not shown) is then attached to the upper end of the solidifying vessel 10, which internally includes the glass-solidified substance 31, to seal the solidifying vessel 10, producing the vitrified radioactive waste 16. The vitrified radioactive waste 16 is stored in a predetermined storage place (not shown).

The present embodiment can obtain the effects generated in the embodiment 1.

Embodiment 7

Figure 7:
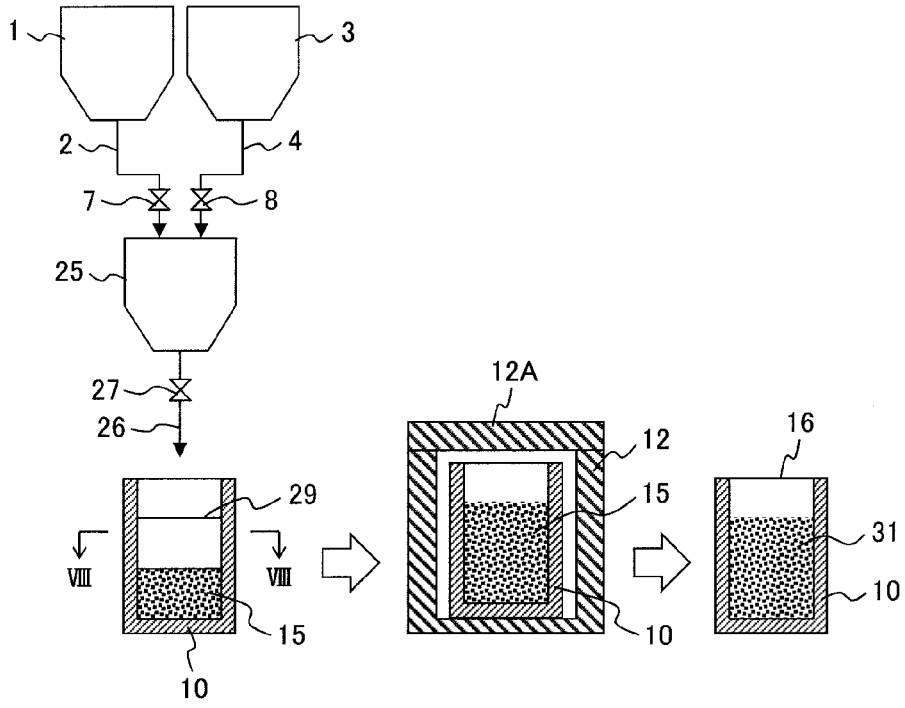
FIG. 7 is an explanatory drawing showing a radioactive waste solidification method according to embodiment 7, which is another preferred embodiment of the present invention.

A radioactive waste solidification method according to embodiment 7, which is other preferred embodiment of the present invention, will be described with reference to FIGS. 7 and 8. In the radioactive waste solidification method according to the present embodiment, 100 kg of high-dose radioactive waste that includes $10^{16}$ Bq of Cs-137 (for example, zeolite to which Cs-137 has been adsorbed) and 100 kg of soda lime glass, which is a glass raw material, with a glass softening point of approximately 700° C. were supplied into a solidifying vessel 10 and a vitrified radioactive waste 16 is produced. In the present embodiment, graphite is not supplied into the solidifying vessel. The radioactive waste solidification method according to the present embodiment will be described below.

Figure 8:
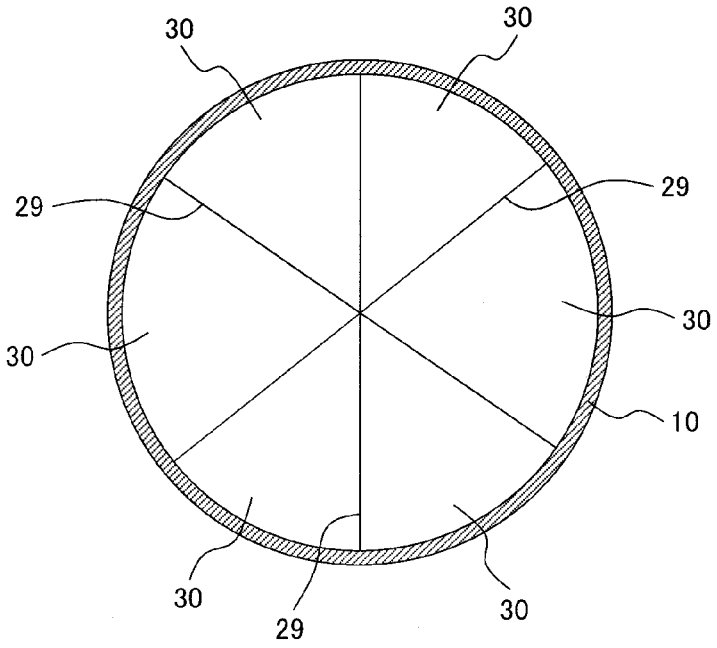
FIG. 8 is a cross-sectional view taken along line VIII-VIII in FIG. 7.

In the solidifying vessel 10 used in the present embodiment, a plurality of metal plates 29 are disposed in the solidifying vessel 10, each of metal plates 29 extending radiately from the center of the solidifying vessel 10 in radial directions of the solidifying vessel 10 (see FIG. 8). One end of each metal plate 29 is in contact with the inner surface of the solidifying vessel 10. The metal plate 29 is made of, for example, iron. However, the metal plate 29 may be made of copper or aluminum. The metal plate 29 extends in the axial direction of the solidifying vessel 10 from the bottom surface of the solidifying vessel 10 to the vicinity of the upper end of the solidifying vessel 10. An upper end of the metal plate 29 is positioned at lower position than an upper end of the solidifying vessel 10. In the solidifying vessel 10, a plurality of waste filling areas 30 defined by the metal plates 29 are formed. In the present embodiment, six waste filling areas 30 are formed in the solidifying vessel 10. A wire netting made of iron, copper, or aluminum may be used instead of the metal plate 29. The metal plate 29 and wire netting are each a thermally conductive member.

In step S1, 100 kg of high-dose radioactive waste (zeolite to which Cs-137 has been adsorbed) 13, which includes $10^{16}$ Bq of Cs-137, in the waste tank 1 and 100 kg of soda lime glass, which is a glass raw material 14, in the glass raw material tank 3, are first supplied into the mixing tank 25, as in the embodiment 6. The radioactive waste 13 and glass raw material 14 are mixed in the mixing tank 25 with an agitator (not shown).

The vacant solidifying vessel 10 in which metal plates 29 are disposed is moved to a position immediately below the mixing tank 25. The mixture 15 of the radioactive waste 13 and glass raw material 14 in the mixing tank 25 is supplied into one of waste filling areas 30 in the solidifying vessel 10 through the supply pipe 26 by opening the opening and closing valve 27. After one-sixth of 200 kg of mixture 15 is supplied to the waste filling area 30, the opening and closing valve 27 is closed to stop the supply of the mixture 15 into the waste filling area 30. Then, the solidifying vessel 10 is rotated so that the lower end of the supply pipe 26 is positioned immediately above another waste filling area 30. When the lower end of the supply pipe 26 reaches a position immediately above the another waste filling area 30, the rotation of the solidifying vessel 10 is stopped and the opening and closing valve 27 is opened to supply the mixture 15 of the radioactive waste 13 and glass raw material 14 in the mixing tank 25 to the another waste filling area 30 in the solidifying vessel 10 through the supply pipe 26. After one-sixth of 200 kg of mixture 15 is supplied to the waste filling area 30, the opening and closing valve 27 is closed to stop the supply of the mixture 15 into the another waste filling area 30. The solidifying vessel 10 is rotated and one-sixth of 200 kg of mixture 15 is supplied to each remaining waste filling area 30 in the solidifying vessel 10 in this way. After the mixture 15 have been supplied to all waste filling areas 30, the process in step S1 in the present embodiment is terminated.

Upon completion of the process in step S1, the processes in steps S2 and S3 are executed as in the embodiment 1. In step S2, adiabatic processing is performed for the solidifying vessel 10 filled with the mixture 15 of the radioactive waste 13 and glass raw material 14 to melt the glass raw material 14 (soda lime glass) in the solidifying vessel 10. Heat transfer on the traverse plane of the solidifying vessel 10 from the central portion to the circumferential portion occurs through the metal plates 29. Therefore, soda lime glass, which is the glass raw material 14, existing in the circumferential portion on the traverse plane of the solidifying vessel 10 is melted fast.

In step S3 in the present embodiment, clearances formed among the radioactive waste 13, graphite, and the like are filled with the melted substance of the glass raw material 14. As a time elapses, the glass raw material 14 melted among the radioactive waste 13 and graphite coagulates, and the glass-solidified substance 31 is produced in the solidifying vessel 10. The glass-solidified substance 31 includes the radioactive waste 13 and graphite, which were combined together by the coagulated glass raw material (soda lime glass) 14. Then, the lid 12A is removed from the adiabatic vessel 12, and the solidifying vessel 10, in which the glass-solidified substance 31 was formed, is taken out from the adiabatic vessel 12. A lid (not illustrated) is attached to the upper end of the solidifying vessel 10, which internally includes the glass-solidified substance 31, to seal the solidifying vessel 10, producing the vitrified radioactive waste 16. The vitrified radioactive waste 16 is stored in a predetermined storage place (not shown).

The present embodiment can obtain the effects generated in the embodiment 1. Furthermore, since, in the present embodiment, graphite is not supplied into the solidifying vessel 10, devices required to supply graphite (such as the graphite tank 5 and the graphite supply pipe 6 provided with the opening and closing valve 9 described in the embodiment 1) are not required, so that the solidification facility used in the radioactive waste solidification method according to the present embodiment can be made compact. In addition, since graphite does not need to be supplied into the solidifying vessel 10, a time taken to produce the vitrified radioactive waste 16 is further shortened.

In each of embodiments 5 to 7, any one of the glasses described in the embodiment 1 may be used as the glass raw material 14, besides soda lime glass. Furthermore, in each of embodiments 5 to 7, the radioactive waste 13 to be solidified with the glass raw material 14 may be clinoptilolite, mordenitem, chabazite, an insoluble ferrocyanide compound, or a titanate compound, besides zeolite.

REFERENCE SIGNS LIST

1: waste tank, 3: glass raw material tank, 5: graphite tank, 10: solidifying vessel (first vessel), 11: agitator, 12: adiabatic vessel (second vessel), 13: radioactive waste, 14: glass raw material, 16: vitrified radioactive waste, 17: pressure reducing vessel (second vessel), 18: pressure reducing pump, 21: air supply pump, 24: thermometer, 25: mixing tank, 28: graphite layer, 29: metal plate, 31: glass-solidified substance.

What is claimed is:

1. A radioactive waste solidification method comprising steps of:

supplying a radioactive waste including a radioactive nuclide, a glass raw material, and graphite into a first vessel;

disposing the first vessel in which the radioactive waste, the glass raw material, and the graphite exist, in an adiabatic area in a second vessel;

heating the radioactive waste and the glass raw material existing in the first vessel disposed in an adiabatic area in the second vessel by heat generated by radiation emitted from the radioactive nuclide and melting the glass raw material in the first vessel; and producing a vitrified radioactive waste by the melt of the heated glass raw materials.

2. The radioactive waste solidification method according to claim 1, wherein in the disposal of the first vessel, in which the radioactive waste, the glass raw material, and the graphite exist, into the adiabatic area, this first vessel is disposed in an adiabatic area formed in an adiabatic vessel being the second vessel.

3. The radioactive waste solidification method according to claim 1, wherein in the disposal of the first vessel, in which the radioactive waste, the glass raw material, and the graphite exist, into the adiabatic area, this first vessel is disposed in a pressure reducing vessel being the second vessel, and a pressure in a space in which the first vessel is disposed is reduced to form the adiabatic area, the space being formed in the sealed pressure reducing vessel.

4. The radioactive waste solidification method according to claim 1, wherein a temperature of the first vessel disposed in the adiabatic area in the second vessel is measured, and a flow rate of gas to be supplied to the adiabatic area in the second vessel is adjusted based on the measured temperature.

5. The radioactive waste solidification method according to claim 3, wherein a temperature of the first vessel disposed in the adiabatic area in the second vessel is measured, and a pressure in the adiabatic area in the second vessel is controlled.

6. The radioactive waste solidification method according to claim 2, wherein a temperature of the first vessel disposed in the adiabatic area in the second vessel is measured, and a flow rate of gas to be supplied to the adiabatic area in the second vessel is adjusted based on the measured temperature.

7. The radioactive waste solidification method according to claim 3, wherein a temperature of the first vessel disposed in the adiabatic area in the second vessel is measured, and a flow rate of gas to be supplied to the adiabatic area in the second vessel is adjusted based on the measured temperature.

8. A radioactive waste solidification method comprising steps of:

supplying a radioactive waste including a radioactive nuclide, and a glass raw material into each of a plurality of waste filling areas, the plurality of waste filling areas being formed with thermally conductive members in a first vessel;

disposing the first vessel in which the radioactive waste and the glass raw material exist, in an adiabatic area in a second vessel;

heating the radioactive waste and the glass raw material existing in each waste filling area in the first vessel disposed in the adiabatic area in the second vessel by heat generated by radiation emitted from the radioactive nuclide and melting the glass raw material in the first vessel; and producing a vitrified radioactive waste by the melt of the heated glass raw materials.

* * * * *